US010774494B2

(12) United States Patent
Kettner

(10) Patent No.: US 10,774,494 B2
(45) Date of Patent: Sep. 15, 2020

(54) METHODS AND DEVICES FOR IMPROVING THE SUBSOIL

(71) Applicant: Maik Kettner, Berlin (DE)

(72) Inventor: Maik Kettner, Berlin (DE)

( * ) Notice: Subject to any disclaimer, the term of this patent is extended or adjusted under 35 U.S.C. 154(b) by 13 days.

(21) Appl. No.: 15/535,199

(22) PCT Filed: Dec. 11, 2015

(86) PCT No.: PCT/EP2015/079428
§ 371 (c)(1),
(2) Date: Jun. 12, 2017

(87) PCT Pub. No.: WO2016/092075
PCT Pub. Date: Jun. 16, 2016

(65) Prior Publication Data

US 2017/0370067 A1 Dec. 28, 2017

(30) Foreign Application Priority Data

Dec. 12, 2014 (DE) ..... 10 2014 225 726

(51) Int. Cl.
*E02D 3/046* (2006.01)
*E02D 3/02* (2006.01)
(Continued)

(52) U.S. Cl.
CPC ..... *E02D 5/46* (2013.01); *E02D 3/054* (2013.01); *E02D 3/074* (2013.01); *E02D 5/56* (2013.01); *E02D 7/06* (2013.01)

(58) Field of Classification Search
CPC .... E02D 5/22; E02D 5/02; E02D 5/72; E02D 27/12; E02D 27/20; E02D 11/00;
(Continued)

(56) References Cited

U.S. PATENT DOCUMENTS 2,334,228 A * 11/1943 Steuermann ..... B01F 3/12 405/271
2,512,831 A * 6/1950 Holmes ..... E02D 5/385 405/237
(Continued)

FOREIGN PATENT DOCUMENTS

DE 7 330 111 U 4/1975
DE 2 629 485 A1 1/1977
(Continued)

OTHER PUBLICATIONS

European Search Report dated Apr. 25, 2016, dated May 3, 2016.
English Translation of European Search Report dated Apr. 25, 2016, dated May 3, 2016.

*Primary Examiner* — Benjamin F Fiorello
*Assistant Examiner* — Edwin J Toledo-Duran
(74) *Attorney, Agent, or Firm* — Norris McLaughlin, P.A.

(57) ABSTRACT

The object of the present invention relates to a method for producing drilled piles, wherein a drilling tool is sunk into the subsoil by applying a drilling torque and a vertical force, the drilling tool is then again retracted and an additional material is introduced into the resulting bore. According to the invention, the drilling tool is set in vibration by one or more actuators while it is sunk into the subsoil and/or during the retraction of the drilling tool, wherein a resulting oscillation amplitude has at least one horizontal portion. The invention also relates to a corresponding drilling tool for producing boreholes or drilled piles in a subsoil. The present invention further relates to a depth vibrator for the displacement and consolidation of subsoil material as well as a method for the displacement and consolidation of subsoil material.

4 Claims, 5 Drawing Sheets

Figure 1:
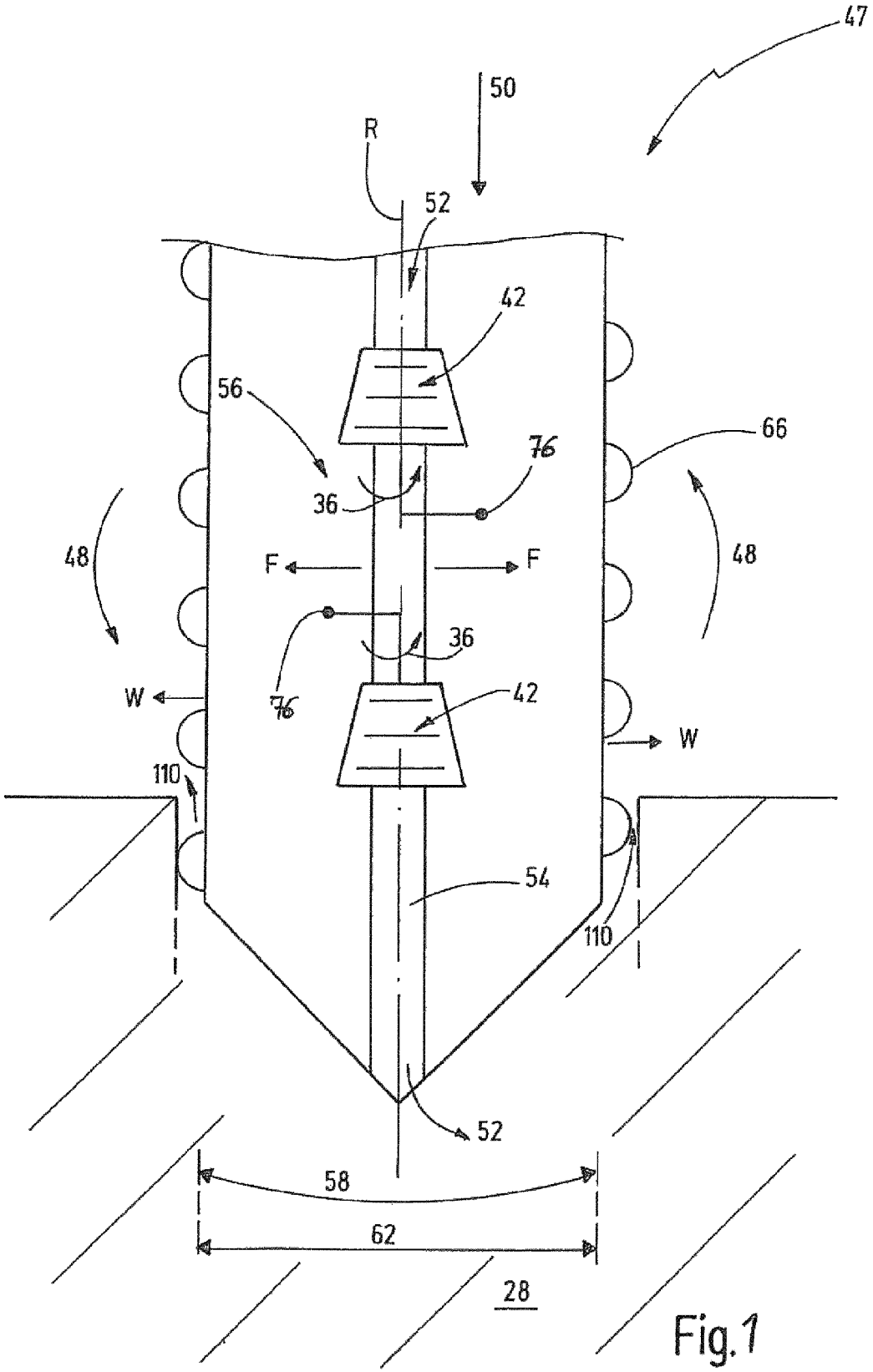

(51) Int. Cl.

| | |
|---|---|
| ***E02D 5/46*** | (2006.01) |
| ***E02D 3/054*** | (2006.01) |
| ***E02D 3/074*** | (2006.01) |
| ***E02D 5/56*** | (2006.01) |
| ***E02D 7/06*** | (2006.01) |

(58) Field of Classification Search

CPC .. E02D 7/00; E02D 9/00; E02D 13/10; E02D 5/34; E02D 5/50; E02D 5/665; E02D 15/04; E02D 7/12; E02D 5/38; E02D 5/62; E02D 5/30; A01G 17/16; E04H 17/26

USPC ..... 405/231, 232, 233, 234, 235, 236, 239, 405/256

See application file for complete search history.

(56) References Cited

U.S. PATENT DOCUMENTS 2,667,749 A * 2/1954 Steuerman ..... E02D 3/054 405/271
2,743,585 A * 5/1956 Berthet ..... E02D 11/00 74/61
2,875,988 A 3/1958 Wysong
2,897,440 A * 7/1959 Hawthorne ..... E21B 47/092 324/221
2,942,849 A * 6/1960 Bodine ..... E21B 7/24 175/55
2,951,681 A * 9/1960 Degen ..... E21B 7/26 175/21
3,049,185 A * 8/1962 Herbold ..... E21B 7/206 175/19
3,054,463 A * 9/1962 Bodine ..... E02D 7/18 175/19
3,168,140 A * 2/1965 Bodine, Jr. ..... E21B 31/005 166/301
3,239,005 A * 3/1966 Bodine, Jr. ..... E21B 33/14 166/286
3,245,223 A * 4/1966 Degen ..... E02D 3/054 405/271
3,254,492 A * 6/1966 Menard ..... E02D 5/36 405/233
3,262,329 A * 7/1966 Herrmann ..... E02D 3/074 74/61
3,277,970 A * 10/1966 Bodine ..... E02D 7/18 175/19
3,282,055 A * 11/1966 Landau ..... E02D 3/054 405/271
3,309,877 A * 3/1967 Degen ..... E21B 7/26 405/271
3,344,874 A * 10/1967 Bodine ..... E02D 7/18 175/56
3,375,884 A * 4/1968 Bodine, Jr. ..... E21B 7/24 175/22
3,453,832 A * 7/1969 Rehmar ..... C08F 8/28 405/241
3,477,237 A * 11/1969 Orkney ..... E02D 7/18 405/232
3,479,829 A * 11/1969 Goodman ..... E02D 5/44 405/238
3,611,735 A * 10/1971 Daczko ..... E02D 5/36 405/241
3,633,688 A * 1/1972 Bodine ..... E21B 7/24 175/55
3,638,433 A * 2/1972 Sherard ..... E02D 1/04 405/50
3,742,717 A * 7/1973 Wey ..... E02D 5/42 405/238
3,800,889 A * 4/1974 Bauer ..... E02D 3/054 175/19
3,808,821 A * 5/1974 Philo ..... E02D 7/22 405/241
4,266,619 A * 5/1981 Bodine ..... E21B 4/006 175/107
4,293,242 A * 10/1981 Merjan ..... E02D 5/44 405/239
4,397,588 A * 8/1983 Goughnour ..... E02D 3/08 405/232
4,403,665 A * 9/1983 Bodine ..... E02D 7/18 175/394
4,667,750 A * 5/1987 Wise ..... E21B 7/18 175/213
5,421,673 A * 6/1995 Esters ..... B09B 1/00 405/129.15
5,515,922 A * 5/1996 Ruttley ..... E21B 31/005 166/177.6
5,733,068 A * 3/1998 Reined, Sr. ..... E02D 7/26 173/184
2003/0044241 A1* 3/2003 Mure ..... E02D 33/00 405/231
2009/0290940 A1* 11/2009 Martin, Sr. ..... E02D 7/16 405/232
2013/0233624 A1* 9/2013 In ..... E21B 17/03 175/170

FOREIGN PATENT DOCUMENTS

| | | | |
|---|---|---|---|
| DE | 198 22 290 | A1 | 12/1999 |
| DE | 199 30 884 | A1 | 2/2001 |
| DE | 100 06 973 | A1 | 9/2001 |
| EP | 0318172 | A2 | 5/1989 |
| GB | 1521627 | A | 8/1978 |
| KR | 100696882 | B1 * | 3/2007 |

* cited by examiner

METHODS AND DEVICES FOR IMPROVING THE SUBSOIL

This application is the U.S. National Stage of International Application No. PCT/EP2015/079428, filed Dec. 11, 2015, which claims foreign priority benefit under 35 U.S.C. § 119 of German application no. 102014225726.3 filed Dec. 12, 2014.

The invention relates to a method for producing bored piles and a boring tool. Objects of the present invention are also a depth vibrator for displacement and consolidation of a construction subsoil material.

In the erection of building structures, the quality of the construction soil is of major significance. In particular with large buildings and those of substantial mass, high demands are imposed on the stability, or load-bearing capacity of the soil. Under usual circumstances, an expert opinion describes the properties of the soil. Dead loads, live loads, and climatically-induced loads must be transferred permanently, reliably, and with little settlement onto the subsoil. If the subsoil is not suitable for resisting the planned loads imposed, a technical adjustment of the properties of the subsoil to meet these demands must be considered.

The depth vibrator for the displacement and compaction of the subsoil, as well as the production of bored piles as additional stability-enhancing structural elements represent established methods in this respect.

One possibility of improving the properties of the subsoil during construction projects consists of establishing pile-like foundation elements in the subsoil, by means of which relatively high loads can be transferred. One possibility for producing pile foundations is provided by the establishment of bored piles. Generally, with this method a boring tool is introduced into the subsoil with the application of a vertical force and a drilling torque or moment. An additional material is introduced into the borehole which is created, which then forms the bored pile. The additional material can be introduced through a hollow core of the boring tool, in this case also referred to as a core driller, or can be filled separately into the borehole.

By way of example, the part-displacement and full-displacement boring method will be considered. Other embodiments of the method are known to the person skilled in the art, and will therefore not be considered separately.

With the part-displacement boring method, a continuous hollow auger is used. This consists of a bore tube which is provided on the outside with a helical worm and is closed at a lower end by a footplate. Conventional hollow augers for such operational purposes are some 3 to 50 meters long and have a diameter of some 300 to 1100 mm. Under the application of a vertical force and a torque moment, the auger is introduced into the subsoil. The surrounding subsoil is displaced and simultaneously compacted. Due to the helical worm, also referred to as a hollow core worm, fitted on the outside of the boring tube, construction material is additionally conveyed. Once the auger has penetrated as far as an area of the subsoil capable of bearing loads, material referred to as reinforcement is, in part, introduced into the hollow core. Next, concrete or an alternative filling material such as mortar for the displacement bored pile is pumped in or filled in, with the simultaneous withdrawal of the hollow auger. In this situation, the footplate usually remains in the subsoil, if it is intended that the reinforcement should be introduced before the withdrawal.

With the full-displacement boring method, a bore tube, at the end of which is located a leader tip, usually with screw threads, is introduced into the soil under the imposition of a vertical force and a torque moment. In this situation, a number of variants have become established, which differ mainly in the shape of the drill tip and of the part of the tip which remains in the soil. Conventional full-displacement boring tools for such operational purposes as this are some 3 to 50 m long and have a diameter of some 200 to 1000 mm. In this situation, the tip displaces the soil almost entirely in the lateral direction, and thereby compacts the area of the earth which surrounds what will later be the pile. In this case, there is no vertical conveying of soil to the surface worth mentioning. Once the bore tube has penetrated as far as the subsoil with load-bearing capacity, reinforcement is introduced in part into the bore tube. Next, the concrete is pumped or poured in, with the simultaneous withdrawal of the bore tube.

The diameter of full-displacement bored piles is usually in the range from 200 to 1000 mm.

When reference is made in connection with the invention described here to full-displacement bored piled, hollow boring tools, or general boring tools, this always includes all known configuration variants of methods and corresponding tools.

In addition to the variants of boring tools described here, all other known variants of boring tools also form the technological background for the invention described in this application. There are, for example, boring tools with which the tip can remain in the subsoil, or with which the tip can be extracted from the subsoil again along with the boring tool. There are also boring tools with which the auger is provided optionally at the tip, the bore tube, or at the tip and at the bore tube. Boring tools without augers are also possible, with which the boring torque moment can be transferred to the subsoil, for example via an outer surface with corresponding friction properties. Any combinations of these and other known variants are also conceivable.

A further possibility for improving the properties of the subsoil during construction projects consists of what are known as the deep vibration methods. These consist in general of methods for compacting and consolidating construction substrates, wherein the subsoil is displaced by a tool, referred to as a depth vibrator, and in the process is compacted. This method, and the associated tools, the depth vibrators, are generally known to the person skilled in the art. In this situation, the depth vibrator is introduced into the subsoil under the application of a vertical force, and during the sinking incurs horizontal vibration. Conventional depth vibrators for such operational purposes are some 2 to 5 m long, have a diameter of some 300 to 900 mm, and weigh about 1 to 6 tonnes. Their length is adjusted to the anticipated working depth by means of extension tubes. In this situation, the depth vibrators are guided by cranes, mechanical diggers, or specially developed carrying devices. A frequency of the vibrations generated by conventional depth vibrators lies in the range of the natural frequency of the subsoil, typically between 25 and 60 Hz. The vibrations are therefore present both as dynamic horizontal deflection of the depth vibrator as well as in the form of a dynamic horizontal force, which is exerted by the depth vibrator onto the surrounding soil area. Since such mechanical relationships are adequately known to the person skilled in the art, hereinafter no further distinction will be made between a force vibration and deflection vibration, since a force which takes effect on a body also always exerts an acceleration effect on this body, which has the consequence of a certain deflection of the body. The horizontal vibrations are therefore transferred onto the surrounding subsoil. If the material of the subsoil is compressible, the horizontal vibrations inherently lead to a displacement and therefore compaction of the subsoil. The compaction results in a consolidation of the subsoil.

By way of example, what is referred to as the vibroflotation method will be considered in detail, a particular form of the deep vibration method, in which the depth vibrator is sunk into the subsoil and then withdrawn repeatedly and at specific distance intervals. Due to the vibrations of the depth vibrator, the friction force between the subsoil grains in relation to one another is briefly reduced. As a consequence of gravity, the grains of the subsoil material then transform into a denser deposit state as soon as the depth vibrator is withdrawn from the area of the subsoil which it has displaced. In this way, existing cavities in the subsoil are made smaller or closed entirely. Subsoils which are particularly coarse-grained, such as those consisting of coarse sand, gravel, or small stones, are well-suited for such compaction. Since the compaction results in a decrease in volume, this must, as a rule, be compensated by surface deposition of material. A consolidated subsoil with the same height level is produced, which is well-suited for carrying substantial loadings.

By way of further example, another particular form of the deep vibrator method is described, referred to as vibro displacement densification. This is well-suited for subsoil materials with small grain sizes, such as silt or clay, as well as organic materials. With such materials, a compaction of the subsoil in itself is no longer possible to an adequate degree. With the vibro displacement densification method, a depth vibrator is operated in alternating steps. With the depth vibrator sunk in the subsoil, an additional material, such as gravel or crushed rock, or even concrete, is introduced into the subsoil, which, after completion, exhibits a higher degree of rigidity than the surrounding soil. The additional material emerges at the tip of the depth vibrator when this carries out a lifting movement. As a rule, the additional material is introduced into the depth vibrator on the ground surface through a lock arrangement, and is conveyed through an external hollow core down to the operating depth of the depth vibrator. The emerging additional material is compacted at the sinking movement of the depth vibrator which follows the lifting movement, as well as being displaced sideways into the subsoil. In this way, what are referred to as plug piles are created successively, which in conjunction with the subsoil are well-suited for bearing the loads.

When reference is made hereinafter to deep vibration methods or depth vibrators, all known configuration embodiments are always included.

By way of example, a conventional depth vibrator is described. Depth vibrators are generally and adequately known to the person skilled in the art. They comprise a bar or rod section, which consists of one or more extension tubes. By means of this, the depth vibrator can be sunk to the desired depth. With depth vibrators for the vibro flotation method, a hollow core can additionally be provided for the conveying of the additional material. The head of the depth vibrator is connected to the bar by means of an elastic coupling. As a rule, the head consists of an elongated housing, arranged in the interior of which are a mechanical elements module and a drive energy source for producing horizontal vibrations. The mechanical elements module consists of a mass with eccentric mass centre of gravity, in other words an unbalance element, as well as a bearing mounting and a drive shaft. The bearing mounting restricts the degrees of freedom of the drive shaft and unbalance element to a rotational degree of freedom.

With conventional depth vibrators, an electric or hydraulic motor is provided as the drive energy source, which in most cases is operationally connected to the drive shaft by means of a positive-fit gear element. The motor with the gear element and the mechanical module together form a drive train. When the motor begins to deliver drive energy to the drive shaft with the unbalance element, the shaft begins to rotate. Dynamic centrifugal forces take effect on the mass with eccentric center of gravity, which result in a transverse acceleration of the entire mechanical module. The mechanical module is therefore set into horizontal vibration. By means of the bearing mounting, the vibrations are transferred onto the housing of the depth vibrator.

The known drive concepts do however exhibit a number of disadvantages. For example, electric drives develop a high degree of waste heat. The system costs and the maintenance expenditure are likewise negatively influenced. With hydraulic drives, the disadvantage lies in the necessary storage and permanent provision of the hydraulic fluid. Leakage losses and pressure losses in the pipelines and hose lines represent further negative aspects.

One object of the present invention consists of providing a method for producing bored piles and a corresponding boring tool of the generic type referred to in the preamble, for producing boreholes and bored piles, wherein, additionally, the boring tool is intended to be of simple configuration and flexibly adjustable to the particular subsoil in each case.

A further object of the invention is to provide a method for displacing and compacting subsoil material, as well as a depth vibrator of the generic types referred to in the preamble, which is of simple configuration and is flexibly adjustable to the subsoil in each case. The objects are solved by the items with the features as set forth hereinafter.

The object of the present invention is a method for producing bored piles.

A boring tool is in this situation sunk into the subsoil under the application of a torque moment and a vertical force, then withdrawn, and an additional material is introduced into the borehole created. According to the invention, it is provided that the boring tool, while being sunk into the subsoil and/or during the withdrawing of the boring tool, is set into vibration by one or more actuating elements, wherein a resulting vibration amplitude comprises a horizontal portion.

This offers the advantage that the friction between the subsoil and the boring tool is reduced, and therefore the forces required for a displacement and/or movement of the subsoil by the boring tool are also reduced, and a horizontal force, taking effect outwards, is exerted onto the subsoil. The wear on the boring tool is thereby reduced, and a compaction of the subsoil material is favored.

Preferably, actuating elements are used which create a vibration with an amplitude in the range from 0.01 mm to 5 mm, for further preference from 0.02 mm to 3 mm, and for special preference 0.03 mm to 2 mm in respect of a horizontal or radial deflection respectively of the boring tool. An amplitude in respect of a horizontal or radial force respectively amounts preferably to 0.5 kN to 1000 kN, for further preference 1 kN to 700 kN, and for particular preference 25 kN to 400 kN. This offers the advantage that a lateral displacement of subsoil only takes place to the extent that is required for the reduction of the friction between the subsoil and the boring tool, and, as applicable, a vertical conveying of subsoil material is not impeded. The energy requirement for the actuator elements is also advantageously kept low.

Preferably, the actuating elements are configured as one or more mutually independent fluid flow machines, particularly preferred as one or more pneumatic turbines, into which, in each case, one or more unbalance elements are integrated.

This provides the advantages that a large band width of operational frequencies and centrifugal forces which can be produced are available, and therefore comparatively flexible and economical forms of actuating elements are used.

The pneumatic turbines are preferably operated at revolution speeds from 1 rev/min to 100,000 rev/min, particularly preferred from 1 rev/min to 50,000 rev/min, and especially preferred from 1 rev/min to 30,000 rev/min.

If it is intended that the pneumatic turbines should be operated at different revolution speeds, then use may be made for example of turbines with adjustable turbine blades. Means for influencing the air flow can also be used, such as valves, flap valves, or suitably designed housing elements of the boring tool. In principle, methods for the mutually independent operation of a plurality of turbines are known to the person skilled in the art.

Further advantageous embodiments of the invention are represented in the subclaims.

In a further preferred embodiment of the method according to the invention, it is provided that, as the boring tool, a hollow boring tool is used, which comprises at least one hollow core, and that additional material is filled through the hollow core of the hollow boring tool into the borehole, before the beginning and/or during and/or after the withdrawal of the hollow boring tool.

This provides the advantage that both the bore hole as well as the bored pile can be produced in one working cycle.

In a further preferred embodiment, it is provided that a reinforcement element is introduced into the hollow core of the hollow boring tools before the filling material is filled into the hollow core of the hollow boring tool.

This provides the advantage that the bored pile can be produced together with the reinforcement element in one working cycle.

A further aspect of the present invention relates to a boring tool for producing bore holes or bored piles in a subsoil. The bore holes produced are suitable in particular for bored piles. According to the invention, it is provided that the boring tool comprises at least one fluid flow machine, wherein at least one unbalance element is integrated into at least one rotor of the at least one fluid flow machine, and the rotor is mounted in the boring tool such as to rotate about a longitudinal axis of the boring tool, such that a resulting vibration can be produced, the vibration amplitude of which comprises at least one horizontal portion.

Boring tool in the meaning of the invention is any device with which a bore torque moment, i.e. a circumferential force, is transferred by way of an outer surface of the device onto the surrounding subsoil.

This provides the advantage that by a corresponding arrangement of the at least one unbalance element, a dynamic operational behavior of the boring tools can be adjusted.

The fluid flow machine can preferably be operated at revolution speeds from 1 rev/min to 100,000 rev/min, particularly preferred from 1 rev/min to 50,000 rev/min, and especially preferred from 1 rev/min to 30,000 rev/min. The unbalance element is preferably configured in such a way, and integrated into the rotor of the fluid flow machine, that the boring tool is configured such that in operation it produces a vibration with an amplitude in the range from 0.01 mm to 5 mm, further preferred from 0.02 mm to 3 mm, and especially preferred from 0.03 mm to 2 mm in respect of a horizontal or radial deflection respectively of the boring tool, or, respectively, a vibration with an amplitude in respect of a horizontal or, respectively, a radial force of preferably 0.5 kN to 1000 kN, further preferred 1 kN to 700 kN, and especially preferred 25 kN to 400 kN. This provides the advantage that the fluid flow machine can be operated at a high revolution speed, which exerts a positive effect on a degree of efficiency of the fluid flow machine.

Further preferred embodiments of the present invention derive from the features referred to in the subclaims.

It is particularly preferred, for example, that the boring tool is provided at least in sections with an auger and/or a tip with screw threads.

This provides the advantage that the boring tool can be flexibly adjusted in respect of its suitability for conveying and/or displacing subsoil material.

In a further preferred embodiment, provision is made for the boring tool being a hollow boring tool, comprising at least one hollow core.

This provides the advantage that, with the hollow boring tool, bored piles can be produced with the method according to the invention for producing bored piles.

It is further preferred that the at least one fluid flow machine is configured as at least one pneumatic turbine.

This provides the advantage that very high revolution speeds can be attained, and the turbine can be driven with an economically advantageous and low-risk operating fluid.

If it is intended that the pneumatic turbines should be capable of being driven at different revolution speeds, then they can, for example, comprise adjustable turbine blades. Means can also be provided for influencing the air flow in the boring tool, such as valves, flap valves, or suitably configured housing elements. In principle, it is known to the person skilled in the art how turbines, and, respectively, the system which provides the operating fluid, are to be configured in order that they can be operated at different revolution speeds.

In a further preferred embodiment it is provided that at least one rotor with turbine blades is mounted on a hollow axle, which is configured as a hollow core.

This provides the advantage that the complexity of the structural design is reduced.

A further aspect of the present invention relates to a depth vibrator for displacing and compacting a subsoil material, comprising at least one rotationally movable unbalance element, wherein the depth vibrator comprises at least one fluid flow machine as the drive for the unbalance element, and wherein the at least one fluid flow machine comprises at least one pneumatically driven turbine. According to the invention, it is provided that the at least one pneumatically driven turbine is operationally connected to the at least one unbalance element by means of at least one induction coupling.

A pneumatic turbine can advantageously be configured such as to be permanently driven at a maximum torque moment. Revolution speed differences between the turbine and the unbalance element can advantageously be compensated for by the induction coupling, such that no mechanical gear arrangement based on a positive fit connection is required. Friction losses can thereby be advantageously avoided. This leads to reduced maintenance effort and expenditure. The configuration with air as the operating fluid for the turbine further provides the advantage that storage and permanent provision of the operating fluid can be done without.

The induction coupling is of the class of externally-actuated switchable couplings with a non-positive working principle. The transfer of force and torque respectively is based in this situation on the principle of a changing magnetic field, which takes effect on a passive electrical conductor. The drive side of the coupling, for example, can create the magnetic field, and is designated hereinafter as the active side. Both permanent magnets as well as electromagnets can be used in order to produce the magnetic field. If an electromagnet is used, it can consist of one or more electrical conductors, through which a regulatable current can flow. With induction couplings, no physical contact takes place between the drive side (active side) and the output side (passive side), referred to hereinafter as the passive side. The passive side can preferably comprise an inherently short-circuited electrical conductor, which is not actively supplied with an electric voltage. If a revolution speed difference pertains between the active and passive side, this results in a relative movement between the active and passive sides. The magnetic field produced by the active side is therefore moved relative to the short-circuited conductor on the passive side. As a result, the Lorenz force takes effect on the short-circuited conductor, as a result of which a torque moment can be transferred from the drive side (active side) onto the output side (passive side) of the induction coupling. The torque moment can preferably take place by the regulating of the electric current which flows through the electrical conductor of the active drive side. A changeover of the active and passive sides is likewise possible. Also possible is the use of two active sides. These structural design alterations can if necessary be undertaken independently by the person skilled in the art. The induction coupling allows for an operation with a sustained revolution speed difference between the drive side and the output side.

Preferably, an induction coupling is used which is configured such as to transfer torque moments of more than 1 Nm on the drive side. Preferably, the drive-side transferrable torque moment values lie in the range from 5 Nm to 100 Nm, and particularly preferably from 10 Nm to 40 Nm. Also preferably, the induction coupling can be operated in the revolution speed ranges on the drive side between 500 rev/min (revolutions per minute) and 50,000 rev/min, preferably between 10,000 rev/min and 40,000 rev/min, and particularly preferably between 10,000 rev/min and 30,000 rev/min. A mechanical force which can be transferred by the induction coupling lies preferably in the range 5 kW to 200 kW, particularly preferably from 10 kW to 60 kW, and especially preferably from 20 kW to 50 kW.

This provides the advantage that substantial revolution speed differences between the pneumatic turbine and the rotating unbalance element can be compensated for, and, at the same time, a high torque moment is available for driving the unbalance element. The spatial requirement of the induction coupling in this situation remains advantageously in the range of a diameter of conventional depth vibrators.

Preferably, an induction coupling with permanent magnets is used.

This provides the advantage that an active supply of the induction coupling with electrical energy can be done without.

For further preference, an induction coupling with an electromagnet is used.

This provides the advantage that the mechanical and thermal behavior of the induction coupling can be controlled by means of the current flow.

It is further preferred that the drive side of the induction coupling, in other words the side of the induction coupling facing the pneumatic turbine, is configured as the passive side, and that the output side, i.e. the side facing the unbalance element, is configured as the active side.

This provides the advantage that resistance losses on the passive side (drive side) incurred by the electrical current flow in the form of heat can be conducted away and conveyed to the pneumatic turbine.

Further preferred is an arrangement of a plurality of induction couplings connected in series.

This provides the advantage that the relative revolution speeds necessary for an effective torque moment transfer between the drive side and output can be reduced.

Preferably, a mass of the rotationally movable unbalance element amounts to between 1 kg and 200 kg, particularly preferably between 5 kg and 60 kg. A mass center of gravity of the rotationally movable unbalance element, related to an axis of rotation, preferably lies at a maximum radial distance interval from the axis of rotation. The structural space available has the effect of a delimiting peripheral condition.

This provides the advantage that, due to the rotation of the unbalance element at revolution speeds which correspond to the range of the natural frequency of the subsoil, adequately large centrifugal forces or vibration amplitudes can be produced.

The pneumatic turbine can preferably be driven at revolution speeds of 500 rev/min and 50,000 rev/min, preferably between 10,000 rev/min and 40,000 rev/min, and especially preferably between 10,000 rev/min and 30,000 rev/min.

A torque moment which can be produced by the pneumatic turbine lies preferably in the range from 1 Nm to 100 Nm, particularly preferably from 10 Nm to 40 Nm, especially preferably at 15 Nm to 25 Nm. A pressure difference of an air quantity which can be used for the operation of the pneumatic turbine, from a turbine inlet to a turbine outlet, preferably amounts to between 1 bar and 30 bar, for further preference between 2 bar and 20 bar, and particularly preferably between 3 bar and 15 bar. This provides the advantage that the pneumatic turbine can provide a high torque moment with a high degree of efficiency.

Further preferred embodiments of the present invention derive from the features presented in the subclaims.

For example, it is provided in a preferred embodiment that the induction coupling is configured such as to convert rotation frequencies on the drive side (drive shaft) into rotation frequencies of preferably between 5 Hz and 120 Hz, particularly preferably between 15 Hz and 90 Hz, and especially preferably between 25 Hz and 60 Hz at the shaft on the output side (output shaft) of the induction coupling.

This provides the advantage that the pneumatic turbine can be permanently operated in a revolution speed range which is optimum for it, while the revolution speed of the rotationally movable unbalance element can be settled in the natural frequency range of the subsoil.

According to a further aspect of the present invention, a method is disclosed for the displacement and compaction of a subsoil material, wherein a depth vibrator is sunk into the subsoil under the application of a vertical force, and the depth vibrator is set into vibration during the sinking, wherein a resulting vibration amplitude comprises at least one horizontal portion. According to the invention, it is provided that the vibrations are produced by at least two kinematically independent rotationally moved unbalance elements, wherein the resulting vibration can be adjusted by the superimposition of the individual vibrations of the independent unbalance elements.

This provides the advantage that adjustment can be made to the frequency of the resulting vibration independently of the rotation frequency of the rotationally moved unbalance elements, and that it is possible to make flexible adjustment to the natural frequency of the subsoil.

Preferably, the rotation frequencies of the respective rotationally moved unbalance elements lie between 20 Hz and 600 Hz, particularly preferably between 30 Hz and 500 Hz, and especially preferably between 50 Hz and 450 Hz. The frequency of the resulting superimposed vibration lies preferably between 5 Hz and 120 Hz, particularly preferably between 15 Hz and 90 Hz, and especially preferably between 25 Hz and 60 Hz.

This provides the advantage that, due to the large individual rotation frequencies, high centrifugal forces can be produced, and, at the same time, the frequency of the resulting vibration can be adjusted to the lower natural frequency of the subsoil.

For further preference, with the method a dynamically resultant centrifugal force is produced by the rotating unbalance elements. A maximum amount of the resultant centrifugal force is preferably 25 kN to 700 kN, for preference 50 kN to 600 kN, and particularly preferably 100 kN to 500 kN. For further preference, with the method a dynamically resulting radial or, respectively, horizontal deflection (amplitude) of the depth vibrator is produced, related to a state outside the subsoil, in which a free vibration is possible which amounts to a maximum amount of preferably 2 mm to 40 mm, for further preference 5 mm to 30 mm, and particularly preferably 7 mm to 20 mm.

It has been found that these process parameters allow for a particularly advantageous compaction of subsoil materials which are processed with the method according to the invention.

Further preferred embodiments of the present invention are derived from the features referred to in the subclaims.

In a further advantageous embodiment it is provided that the rotational movement of the unbalance elements is effected by at least one fluid flow machine.

Fluid flow machines, due to the high revolution speeds which they can achieve, provide particular advantages in the production of high centrifugal forces.

In a further advantageous embodiment, it is provided that at least one pneumatic turbine is used as the at least one fluid flow machine. The pneumatic turbine is preferably operated at revolution speeds from 500 rev/min to 50,000 rev/min, particularly preferably from 10,000 rev/min to 40,000 rev/min, and especially preferably from 10,000 rev/min to 30,000 rev/min. A torque moment produced by the pneumatic turbine lies preferably in the range from 1 Nm to 100 Nm, particularly preferably from 10 Nm to 40 Nm, and especially preferably from 15 Nm to 25 Nm. A pressure difference of an air quantity used for the operation of the pneumatic turbine, from a turbine inlet to a turbine outlet, amounts preferably to between 1 bar and 30 bar, for particular preference between 2 bar and 20 bar, and especially preferably between 3 bar and 15 bar.

This provides the advantage that very high revolution speeds are achieved, and the turbine is operated at a working point at which the degree of efficiency is high. Further advantages are derived from an economic and low-risk working fluid in the form of compressed air.

If it is intended that the pneumatic turbines should be operated at different revolution speeds, then use can be made, for example, of turbines with adjustable turbine blades. It is also possible to use means for influencing the air flow such as valves, flap valves, or suitably designed housing elements of the depth vibrator. In principle, methods are known to the person skilled in the art for the mutually independent operation of a plurality of turbines.

According to a further aspect of the present invention, a depth vibrator for the displacement and compaction of a subsoil material is disclosed, which comprises one or more rotationally movable unbalance elements. According to the invention, it is provided that the unbalance elements are integrated in each case in an assigned pneumatic turbine.

This provides the advantage that the depth vibrator comprises a lower number of moved components, in particular relative to one another. The complexity of the system is advantageously reduced.

In an advantageous embodiment, the unbalance elements are arranged in one or more rotors of the pneumatic turbine. Also possible is an arrangement of the unbalance elements in each case in a shaft, in the event of all the turbine stages being mounted on a separate shaft.

Both variants provide the advantage that a mass distribution of the unbalance elements can be arranged in a specific and precise manner. Moreover, a decentralized arrangement of the unbalance elements in the turbine allows for a partial rearrangement, in order for the mass characteristics of the turbine or of the unbalance elements to be changed in a specific manner.

If it is intended that the pneumatic turbines should be capable of being driven at different revolution speeds, they can, for example, comprise adjustable turbine blades. Means can also be provided for influencing the air flow in the depth vibrator, such as valves, flap valves, or suitably configured housing elements. In principle, it is known to the person skilled in the art how turbines, or, respectively, the system which provides the operating fluid, are to be configured such that they can be operated at different rotational speeds.

Preferably, masses of the rotationally movable unbalance elements amount in each case to between 0.1 kg and 3 kg, particularly preferably between 0.2 kg and 2 kg. A mass center of gravity of the rotationally movable unbalance element, related to an axis of rotation, preferably lies at a maximum radial distance interval from the axis of rotation. A restrictive peripheral condition is the structural space which is available.

This provides the advantage that, due to the rotation of the unbalance elements at revolution speeds which, due to the vibration superimposition, correspond to the range of the natural frequency of the subsoil, adequately high centrifugal forces and vibration amplitudes respectively can be created.

The pneumatic turbines with the unbalance elements can preferably be driven at revolution speeds from 1 rev/min to 100,000 rev/min, particularly preferably from 1 rev/min to 50,000 rev/min and especially preferably from 1 rev/min to 30,000 rev/min.

Further embodiment variants are derived from advantageous combination of the features referred to and contained in the exemplary embodiments. Moreover, a transfer of the disclosed technical teaching to further methods and associated devices for improving the mechanical subsoil properties are possible, with which a creation of horizontal vibrations provides a specific advantage.

Figure 2:
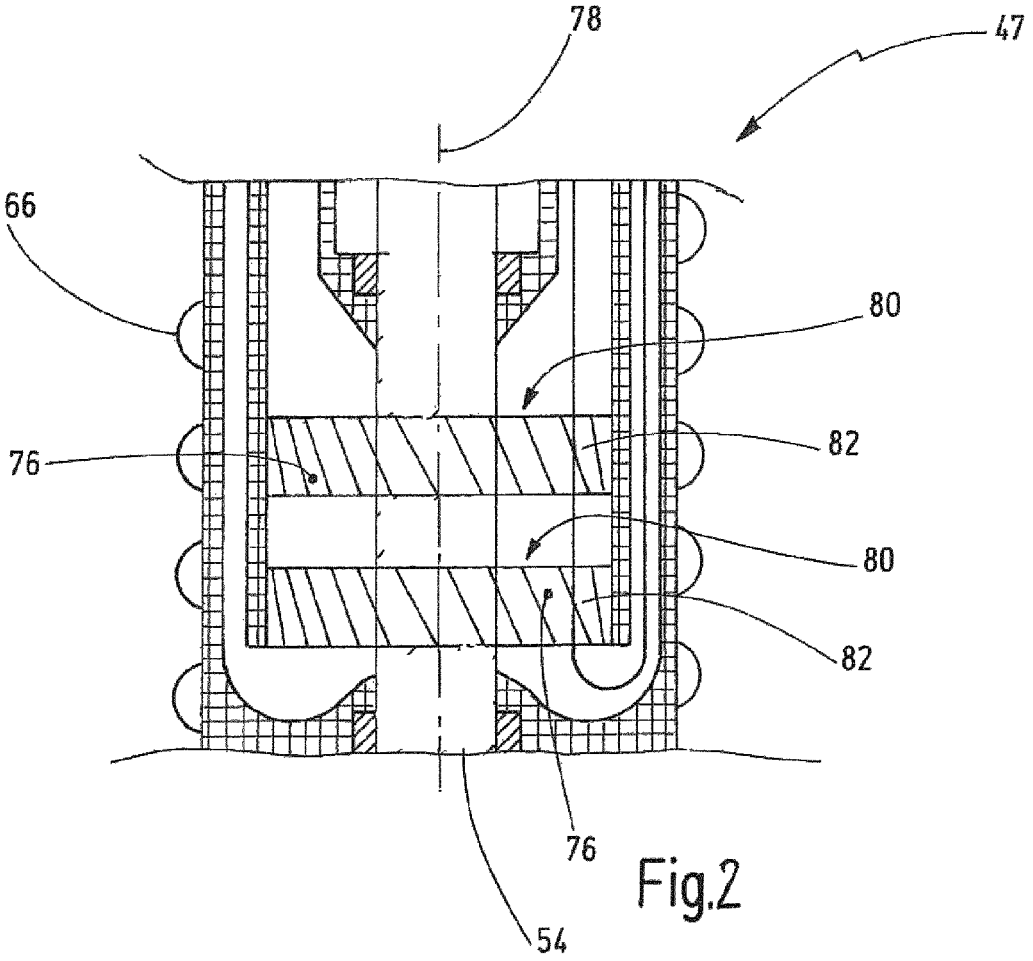
Figure 3:
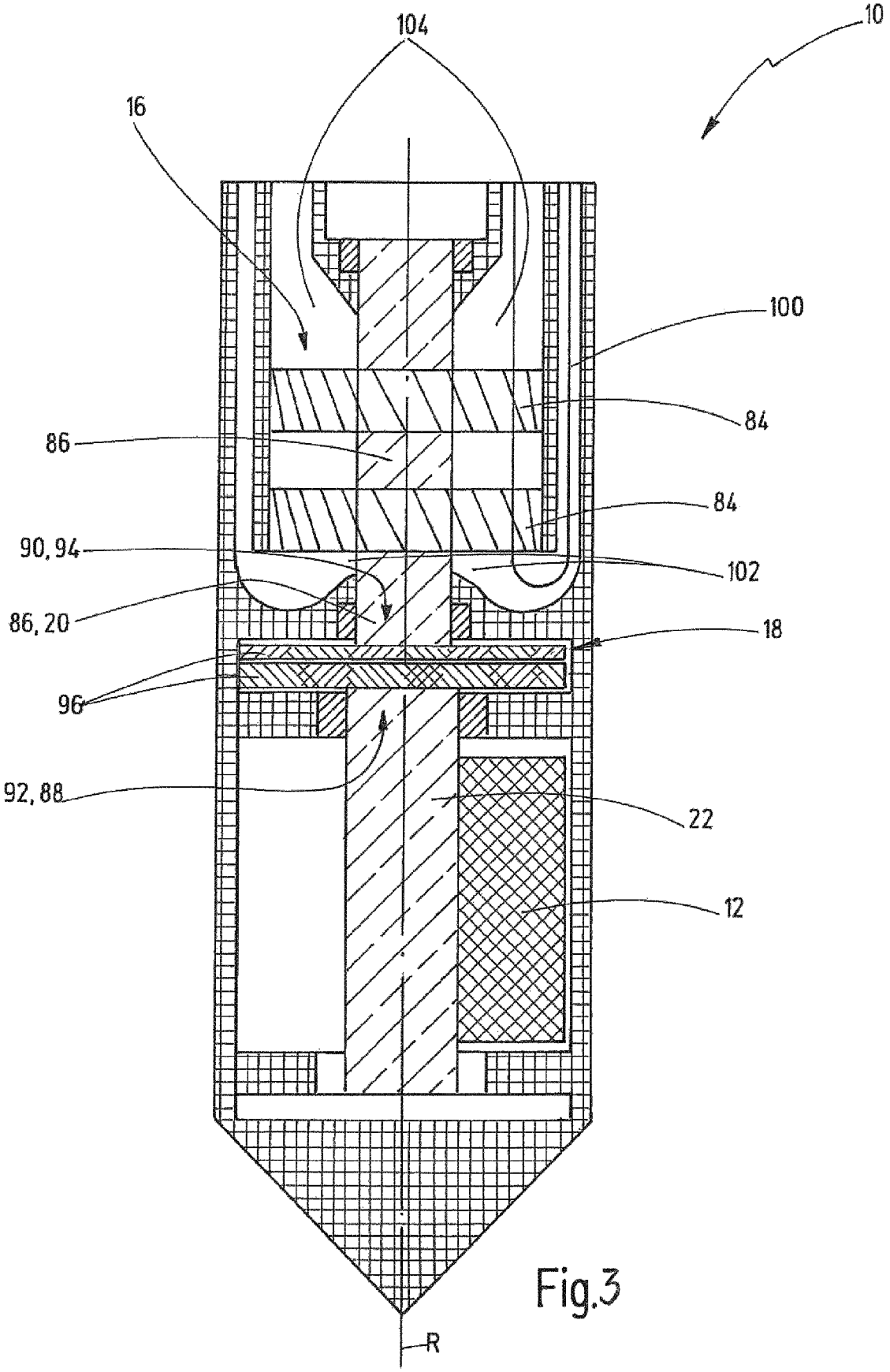
Figure 4:
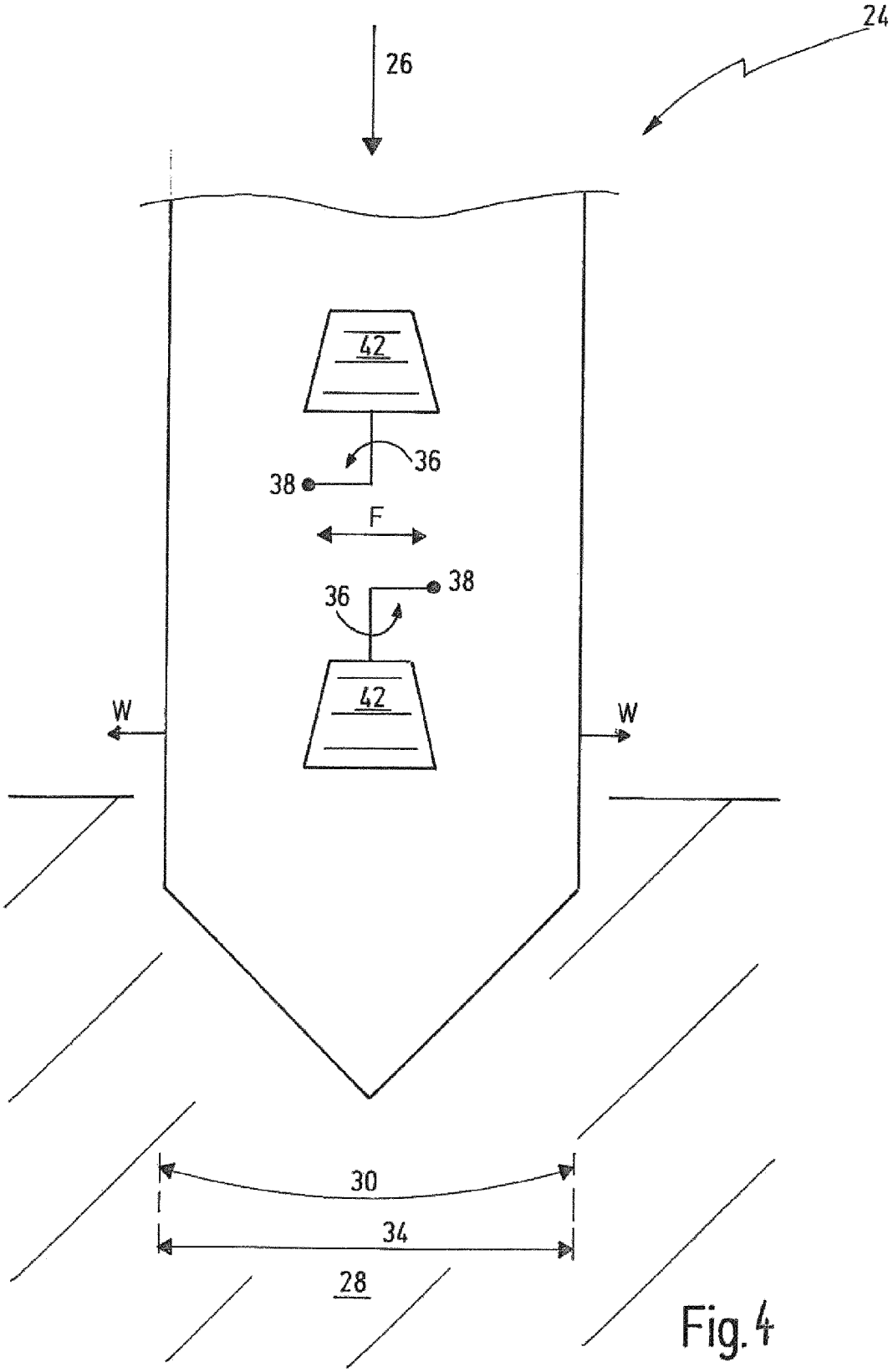
Figure 5:
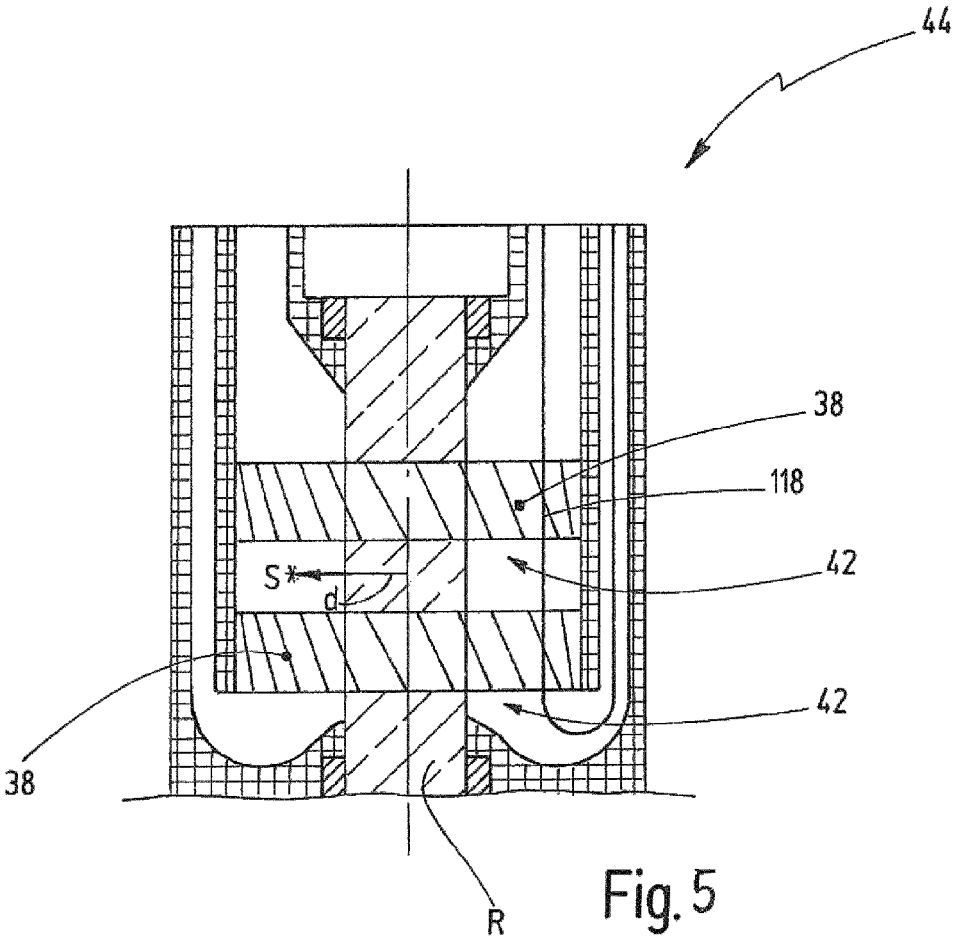

The invention is described in greater detail hereinafter on the basis of an exemplary embodiment and the associated drawings. The figures show:

FIG. 1 a preferred embodiment of a method according to the invention for producing displacement bored piles;

FIG. 2 a preferred embodiment of a hollow boring tool according to the invention;

FIG. 3 a preferred embodiment of a depth vibrator according to the invention, with pneumatic turbine and induction coupling;

FIG. 4 a preferred embodiment of a method according to the invention for displacing and compacting a subsoil material, and FIG. 5 a preferred embodiment of a depth vibrator according to the invention with two independent pneumatic turbines with integrated unbalance elements;

FIG. 1 shows a preferred embodiment of a method according to the invention for producing displacement bored piles in a schematic representation. The temporal sequence of the method steps derived from the following description. A hollow boring tool 47 is in this situation sunk into the subsoil 28 with the application of a drilling torque or moment 48 about a rotation axis R and a vertical force 50 along a rotation axis R.

By means of actuating elements 56 in the form of two mutually independent pneumatic turbines 42 with integrated unbalance elements 76, the hollow boring tool 47, while sunk into the subsoil 28, is set into vibration 58. In this situation, initially multiple vibrations 36 are incurred by the two unbalance elements 76 moved rotationally by the turbines 42. The resulting vibration 58 can be adjusted by the superimposition of the individual vibrations 36 of the independently rotationally moved unbalance elements 76. A resulting vibration amplitude comprises a horizontal portion 62, which accounts for more than 95% of the total vibration amplitude. The rotation frequencies of the two rotationally moved unbalance elements 76 are 200 Hz and 300 Hz, wherein the allocation in a design arrangement is freely selectable. In the process, a vibration 58 is produced which corresponds to a dynamic resulting centrifugal force F which exhibits a maximum amount of 175 kN. Moreover, the vibration 58 corresponds to a dynamic radial or horizontal deflection W respectively of the hollow boring tool 47 with a maximum amount of 0.2 mm. When the hollow boring tool 47 is sunk into the subsoil 28, a vertical subsoil conveyance 110 takes place by means of an auger 66, which is arranged on the outside of the hollow boring tool 47. When a predetermined operating depth in the subsoil 28 has been reached, concrete is filled as additional material 52 through a hollow core 54 of the hollow boring tool 47, and the hollow boring tool 47 is then withdrawn.

FIG. 2 shows a schematic representation of a preferred embodiment of a hollow boring tools 47 according to the invention. The hollow boring tool is particularly well-suited for the method described in FIG. 1. The hollow boring tool 47 is provided with an outer surface with an auger 66, and comprises a hollow core 54. The hollow boring tool 47 further comprises two mutually independent pneumatic turbines 80, of which the rotors 82 are fitted with turbine blades on a common longitudinal axis 78, which forms the hollow core 54. Integrated into the rotors 82 of the turbines 80 is in each case an unbalance element 76. The turbines 80 are designed for a rated revolution speed of 25,000 rev/min. The unbalance elements 76 are configured in such a way, and integrated into the rotors 82 of the turbines 80 in such a way that the hollow boring tool 47 is arranged such that, in operation, it creates a vibration with a maximum amplitude of 0.4 mm in respect of a horizontal or radial deflection respectively of the hollow boring tool 47, or a vibration with a maximum amplitude in respect of a horizontal or radial force of 150 kN.

FIG. 3 shows a schematic representation of a preferred embodiment of a depth vibrator 10 according to the invention, with a pneumatic turbine 16 and induction coupling 18. The depth vibrator 10 comprises a rotationally movable unbalance element 12. The unbalance element 12 can be driven by a fluid flow machine, which is configured as a two-stage pneumatically-driven turbine 16. Two rotors 84 of the turbine 16 are arranged on a common shaft 86 with a rotation axis R. One end of the shaft 86 is a drive shaft 20 for the induction coupling 18. A drive side 90 of the induction coupling 18, i.e. a side of the induction coupling 18 facing towards the pneumatic turbine 16, is configured as the passive side 94, and an output side 92, i.e. a side facing towards the unbalance element 12, is configured as the active side 88. The induction coupling 18 is configured such as to transfer a rated torque moment of 25 Nm, at a rated revolution speed of 20,000 rev/min, onto the drive shaft 20 and 50 Hz onto an output shaft 22. A mechanical force transferrable by the induction coupling 18 lies in the range of 60 kW. The induction coupling 18 is provided on the active side 88 with permanent magnets, which are configured such as to produce an induction magnetic field. A mass of the rotationally movable unbalance element 12 amounts to 20 kg. The pneumatic turbine 16 is designed for a nominal revolution speed of 20,000 rev/min and a rated torque moment of 25 Nm. A rated output which can be provided by the pneumatic turbine 16 is 60 kW. A pressure difference of an air volume flow 100, which can be used for the operation of the pneumatic turbine 16, from a turbine inlet 104 to a turbine outlet 102, amounts to 7 bar at a rated operating point.

FIG. 4 shows a schematic representation of a preferred embodiment of a method according to the invention for the displacement and compaction of a subsoil material. The temporal sequence of the method steps is derived from the following description. A depth vibrator 24 is in this situation sunk into the subsoil 28 under the application of a vertical force 26. The depth vibrator 24 is set in vibration 30 during the sinking. Multiple vibrations 36 are produced in this situation by two kinematically independent rotationally moved unbalance elements 38, The rotational movement of the unbalance elements 38 is generated by two pneumatic turbines 42. The resulting vibration 30 can be adjusted by superimposition of the individual vibrations 36 of the independent unbalance elements 38. A resulting vibration amplitude comprises a horizontal portion 34, which makes up more than 95% of the total vibration amplitude. In the process, a resulting vibration 30 is produced, which corresponds to a dynamic resulting centrifugal force F of the rotating unbalance elements 38 with a value of 150 kN. Moreover, the resulting vibration 30 corresponds to a dynamic radial or horizontal deflection W respectively of the depth vibrator 24. A maximum amount of the resulting radial or horizontal deflection W respectively of the depth vibrator 24 is 8 mm.

FIG. 5 shows a schematic representation of a preferred embodiment of a depth vibrator 44 according to the invention, with two independent pneumatic turbines 42 with integrated unbalance elements 38. The unbalance elements 38 are in each case integrated in an associated pneumatic turbine 42, or, respectively, are in each case integrated in a rotor 118 of the associated turbine 42. The rotors 118 are mounted on a common rotation axle R. Masses of the rotationally movable unbalance elements 38 are 0.25 kg and 0.5 kg, wherein the allocation of the masses to the unbalance elements 38 in a structural design arrangement is freely selectable. A resulting mass centre of gravity S of the rotationally movable unbalance elements 38, related to the rotation axle R lies at a maximum radial distance interval d, which is limited by the structural space available.

REFERENCE FIGURE LIST

10 Depth vibrator
12 Unbalance element
16 Pneumatically driven turbine
18 Induction coupling
20 Drive shaft
22 Output shaft
24 Depth vibrator
26 Vertical force
28 Subsoil
30 Vibration
34 Horizontal portion
36 Vibrations
38 Unbalance elements
42 Pneumatic turbine
44 Depth vibrator
47 Hollow boring tool
48 Drilling torque moment
50 Vertical force
52 Additional material
54 Hollow core
56 Actuating elements
58 Vibration
62 Horizontal portion
66 Auger
76 Unbalance element
78 Longitudinal axis
80 Pneumatic turbine
82 Rotors
84 Rotors
86 Shaft
88 Active side
90 Drive side
92 Output side
94 Passive side
96 Coupling disks
100 Air volume flow
102 Turbine outlet
104 Turbine inlet
110 Vertical subsoil conveyance
118 Rotor
d Radial distance interval
F Resulting centrifugal force
R Rotation axis
S Mass centre of gravity
W Deflection

The invention claimed is:

1. A boring tool configured for producing bore holes or bored piles in a subsoil, wherein a drilling torque moment and a vertical force can be applied to the boring tool, so that said boring tool can be driven to rotate by said drilling torque moment and can be sunk down into said subsoil by said vertical force, thereby drilling down into said subsoil and vertically moving subsoil by means of an auger or a tip with screw threads, and wherein said boring tool can then be withdrawn again from the created borehole, and said boring tool further comprises at least one fluid turbine, wherein, in at least one rotor with at least one turbine blade of the at least one fluid turbine, at least one unbalance element is integrated, and the rotor is rotatably mounted about a longitudinal axis of the boring tool in the boring tool, such that a resulting vibration can be produced, the vibration amplitude of which comprises a horizontal portion that accounts for at least 95% of the total resulting vibration amplitude.

2. The boring tool according to claim 1, wherein the boring tool is a hollow boring tool, comprising at least one hollow core.

3. The boring tool according to claim 1, wherein the at least one fluid turbine is at least one pneumatic turbine.

4. The boring tool according to claim 3, wherein said at least one rotor with turbine blades is mounted on a hollow axis, which is configured as a hollow core.

* * * * *